US005851264A

United States Patent [19]

Raaness

[11] Patent Number: 5,851,264

[45] Date of Patent: Dec. 22, 1998

[54] METHOD AND AGGLOMERATES FOR PRODUCTION OF FESI

[75] Inventor: Ola Schiefloe Raaness, Trondheim, Norway

[73] Assignee: Sinvent AS, Trondheim, Norway

[21] Appl. No.: 605,132

[22] PCT Filed: Sep. 9, 1996

[86] PCT No.: PCT/NO94/00149

§ 371 Date: Mar. 13, 1996

§ 102(e) Date: Mar. 13, 1996

[87] PCT Pub. No.: WO95/08005

PCT Pub. Date: Mar. 23, 1995

[30] Foreign Application Priority Data

Sep. 13, 1993 [NO] Norway ..... 933264

[51] Int. Cl.[6] ..... C22C 33/04; C22C 35/00

[52] U.S. Cl. ..... 75/320; 75/10.5

[58] Field of Search ..... 75/320, 10.5

[56] References Cited

U.S. PATENT DOCUMENTS 3,759,695 9/1973 Downing ..... 75/10.5

*Primary Examiner*—Melvyn Andrews

*Attorney, Agent, or Firm*—Dennison, Meserole, Pollack & Scheiner

[57] ABSTRACT

In the production of ferrosilicon in an electric reduction furnace by the reaction of iron-containing, silica-containing and carbonaceous materials, agglomerates containing a substantially homogeneous mixture of iron or a reducible iron compound and a carbonaceous material are used to replace at least a portion of the iron-containing materials in the furnace. These agglomerates have a weight ratio of carbon to iron of 0.2:1 to 1.5:1 in their reduced form after reaction in the furnace.

12 Claims, No Drawings

METHOD AND AGGLOMERATES FOR PRODUCTION OF FESI

The present invention concerns a method for production of ferrosilicon, according to the introductory of claim 1, and agglomerates for use in said method.

TECHNICAL BACKGROUND

In the production of ferrosilicon in an electric reducing furnace, quartz, a carbonaceous reducing agent, which can comprise coke and coal, is charged, and usually char coal or wood chips. The iron components are usually charged as iron oxide pellets, and in some particular cases as particularly selected scrap iron.

The reduction of the silicon component, quartz ($SiO_2$), occurs in two steps. The first oxygen molecule is removed by reacting the quartz with a carbonaceous component to form CO and SiO,—a gas which is stable at elevated temperatures. A substantial part of the energy supplied to the reduction furnace is consumed to effect the removal of this oxygen molecule and form the SiO gas:

$$SiO2(s)+C(s)\rightarrow SiO(g)+CO \quad (I)$$

In this technical field it is an acknowledged opinion that in order to obtain an energy effectice production of ferrosilicon, the gas must be conserved or kept inside the furnace. This is typically performed by two reactions; in the upper part of the furnace SiO reacts with C from the reduction materials for the formation of silicone carbide. If reducing agents having high reactivity with respect to gaseous SiO is used, the reaction occurs until all free carbon has been comsumed to form carbide:

$$2C+SiO(g)\rightarrow SiC(s)+CO \quad (II)$$

or condenses according to the following reaction to form glassy sticky phases which results in a worsened operation of the furnace:

$$2\ SiO\ (g)\rightarrow SiO_2\ (s)+Si\ (l) \quad (IIa)$$

Farther down in the furnace, SiO reacts with silicon carbide for the formation of silicone or ferrosilicon and CO gas, or ferrosilicon if iron is present:

$$SiC+SiO(g)\leftarrow\rightarrow 2Si(l)+CO \quad (III)$$

Farther down in the furnace, SiC in reactant mass flowing downwards contacts a gas having a higher content of SiO an less CO. Thus, the chemical equilibrium allows for conversion of more SiO gas to Si or FeSi from the reaction with SiC and iron flowing downwards.

The chemical equilibrium conditions promise reaction of only a limited amount of the gaseous SiO to form Si or FeSi. These reactions occur, according to persons skilled in the art, in the lowest and hottest part of the melting furnace.

Some SiO gas will usually pass the carbon ureacted, and in part there will be to little free carbon to support the reaction with the gaseous SiO flowing upwards towards the top of the furnace. Some of this gas can however condense and liberate heat to the charge in the upper parts of the furnace and effect heating of the same. The amount of condensing SiO gas-at the upper parts of the furnace will decrease with increasing temperature in the furnace top. A simlified progress of such condensation is as follows:

$$2SiO(g)\rightarrow 2SiO(s)\rightarrow SiO_2+Si \quad (IV)$$

The portion of the gas which remains un-condensed will however flow out of the furnace to the environments and oxidize to form silicone dioxide, and will in this way result in loss of mass and energy from the process. The yield with respect to elementary silicon from such a process is, when the process is run at equilibrium, limited to about 11 percent. If the furnace is charged with $SiO_2$ in excess to consume SiC, the yield of elementary silicone can be increased to 19.2 percent. This yield at equilibrium can be further increased, to about 32 percent, by allowing the carbon component in the charge to react with the gaseous SiO leaving the furnace to form SiC and CO.

In practice, such processes are however not run at equilibrium in the silicone producing part of the furnace, whereby the yield with respect to elemental silicone is increased to 85–94 percent. The remaining of the silicone component charged to the process is lost as SiO gas or evaporated silicone.

We are familiar with experiments with iron containing coke for the production of ferrosilicone at the end of the 1960's. This project was not continued since the experiments failed to exhibit the properties as performed by the material used in the present invention.

OBJECT

The main object of the present invention is to provide a method and a means to increase the Si yield further by the production of ferrosilicon, and thus decreasing the energy and material consumption in such production.

THE INVENTION

We have surprisingly discovered that if at least a part of the ordinarily used iron-containing material with an agglomerate comprising a substantially homogenous mixture of a reducible iron compound, optionally elementary iron, and a carbonaceous material, the gaseous SiO is absorbed to a higher extent than by the use of a corresponding quantity of separate carbon. Thus, the mass and energy loss from a ferrosilicon process can be further decreased, whereby the silicone yield increases considerably compared with known methods.

The term "briquet" is used in the following description. This term is meant to encompass agglomerates or bodies exhibiting a more or less homogenous mixture of carbonaceous material and iron material. Moreover, such bodies should exhibit a porosity sufficient to effect absorption and reaction of flowing SiO gas and Fe/C in the body, and in addition exhibit a strength suffcient to withstand the conditions wich are present in a melting furnace. The briquets can accordingly be provided in any shape, such as granules, lumps, chips, spheres etc, by any suitable method such as mixing and pressing in roller presses, extruding machines or pelletizing equipment.

The gaseous SiO which is assumed to be generated in the electrode crater area and moves upwards through the charge, is further absorbed in carbon in the briquets and forms SiC, which takes part in a part of the reaction process as stated in the formula III above, and form CO, FeSi and elementary Si. The FeSi is assumed to be formed from the dissolution of Si present in SiC into the iron molten mass with the formation of FeSi. Normally, known methods would provide a Si-content in FeSi of 19–25%, to a certain degree dependent on the temperature. By performing the method of the present invention by using briquets comprising iron and carbon, we have surprisingly discovered that a Si content in FeSi of 64% can be obtained.

In order to obtain best possible reduction of the gaseous silicon monoxide in such briquets, the carbon and iron components should, as mentioned above, be sufficiently available to the outgoing SiO gas, i.e., the briquet is substantially gas permeable and substantially homogeneous with respect to the degree of mixing of the separate components of the briquet, so that the reaction of SiO and C can occur without hindrance. Professionals would have denoted this property of the material as "high SiO reactivity". A distinctive stamp of such materials is that they should have high porosity. We assume that the porosity should be at least 30%, and porosities in the range from 60 to 80% with respect to completely reduced material will generally effect a high and satisfactory SiO reactivity. The using iron compounds in such briquets should be present as an easily reducible iron compound. The most preferred form of iron will, however, be elementary powedery iron, but because of the cost connected with powdery iron, iron oxide is preferred. If iron oxide is used, e.g. magnetite ($Fe_3O_4$) can be oxidized to hematite ($Fe_2O_3$) prior to the mixing with the carbonaceous material and following briquet formation, since the latter iron compound is more reducible to elementary iron through a heating prior to or in the ferrosilicon process, for the following formation of ferrosilicon. However, other reducible iron compounds can be used, either in combination or alone, such as iron hydroxides and iron carbonate, but iron oxide is preferred for use with the present invention because of its availability and cost.

Moreover, the grain size of the iron compound in the briquets will affect the performance. A fine material will provide a finely dispersed iron phase having large surface area and thus large reaction surface. In practice, commercial iron sligs will be chosen for economical and practical reasons.

As stated above, the production of the briquets can be effected in any suitable manner, as long as the desired briquet properties are achieved. In general, a carbonaceous material, such as coal, coke, char coal, wood chips and similar, is mixed homogenously with a reducible iron compound, preferably hematite, which is pressed to form briquets, optionally accompanied by addition of a binder. The grain size of the carbonaceous particles should however not exceed 5 mm with respect to agglomeration, but this depends on the particle size distribution. A high content of fines will allow presence of particles having relatively large maximum size. This portion has a maximum limit imposed by the stability and self-supporting properties of the briquets, including the necessity of homogenous iron oxide dispersion within the briquet. In a preferred embodiment, the respective green briquets should not have a volume exceeding about 14 ml and having a pillow-like shape or almond shape.

The use of swelling coal, i.e. coal that during heating becomes plastic in a temperature interval and thereafter solidifies, forms a pore structure favourable for briquets for use with the present invention, which in addition serves as a binder for the briquet. The swelling degree is stated according to an international scale as Free Swelling Index (FSI, the scale ranging from 0 to 10, in which 0 is a non-swelling coal and 10 is a strongly swelling coal). In connection with the present invention, FSI should be at least 1, but higher values are preferred, such as 8–9, as used in the examples below.

The ratio between carbon and iron in such briquets will be reflected by the composition of the reacted briquet, when the iron component has been reduced. A high ratio of carbon to iron produces a high Si content in FeSi and a relatively large quantity of SiC in the briquet whereas a lower ratio of carbon to iron yields in comparison a lower content of SiC and more FeSi having less Si. However, the optimum composition of the briquet in a silicone furnace will depend on the properties of the remaining charge components. Typically, the ratio between carbon and completely reduced iron in a briquet will be within the range of from 0.2:1 to 1.5:1. A preferred carbon to iron ratio in a briquet is however about 1.2:1, which according to experiments has shown to produce the highest yield of FeSi with the highest content of Si. However, if the carbon to iron ratio becomes too low, there will be too little carbon left after reaction with SiO to provide sufficient reduction material left for reduction of the SiO gas.

In a preferred embodiment of the present method relatively small briquets are used, e.g. of the same size as the reduction materials used in known processes. A small briquet size provides a large macroscopic surface and then a large area available to mass interchange between furnace gas and briquet. Moreover, the agglomerates can be sintered prior to the charging to a FeSi melting furnace or sintered on the furnace top. An initial sintering will result in an evaporation of volatile components present in the coal, thus decreasing the need for off-gass purification in a ferrosilicone melting furnace as compared with use of un-sintered briquets.

EXAMPLE 1

The present example is meant to illustrate the reactivity of carbon/iron based briquets for use with the present method to SiO gas in an imagined reactor.

The reactivity of carbon/iron-based briquets with respect to SiO gas was measured in laboratory scale with briquets having various composition and particle sizes produced from coal and iron ore slig. Briefly, the briquets were produced by cold pressing and sintering, whereupon the sintered briquets were subjected to a shock heating similar to the conditions that occur in the top of a FeSi furnace, and then, the briquets were subjected to chemical reaction conditions similar to a FeSi melting furnace.

Slag quality

The slag used in these experiments was pellet slig from AS Sydvaranger, Norway, which composition was as follows:

TABLE 1

Slig composition

| Compound | Percentage |
|---|---|
| Fe (tot) | 67.0 (of which 92.5% is $Fe_3O_4$) |
| $SiO_2$ | <4.80 |
| CaO | 0.30 |
| MnO | 0.10 |
| MgO | 0.35 |
| $Al_2O_3$ | 0.30 |

TABLE 2

Particle size distribution slag

| Particle size (μm) | %-distribution |
|---|---|
| −106 | 96 |
| −75 | 88 |
| −45 | 75 |

Coal quality

The coal used was Longyear coal from Store Norske Spitsbergen Kullkompani. The coal was crushed and screened to different grain sizes. Some important parameters of the coal is listed in Table 3 below.

TABLE 3

| Coal composition | |
|---|---|
| Component | weight % |
| $H_2O$ | 3 |
| Ash | 4 |
| V.M.* | 38 |
| Fix C | 55 |
| FSI** | 8.5 |

*V.M.-volatile
**FSI-free-swelling index, a value for the expansion ability of the coal, cf. ASTM D720-6

Pressing

Coal and slig were mixed and pressed in cold condition. The pressing was performed in a hydraulic press with variable load. The pressing tool was cylindrical with a diameter of 30 mm. These green briquets having a length of 10–15 mm would then be expected to have sufficient strength to pass through the next step of sintering. Table 4 shows the parameters which were varied in these experiments.

TABLE 4

| Briquet parameters | | | | |
|---|---|---|---|---|
| | Composition | | Particle size | Press |
| Experiment no. | wt % coal | wt % slig | coal (mm) | load (tons) |
| 1 | 45 | 55 | <1 | 10 |
| 2 | 45 | 55 | <2 | 15 |
| 3 | 45 | 55 | 1–2.8 | 20 |
| 4 | 40 | 60 | 1–2.8 | 20 |
| 5 | 40 | 60 | <2 | 20 |
| 6 | 60 | 40 | <2 | 20 |
| 7 | 64 | 36 | <2 | 20 |
| 8 | 60 | 40 | <1 | 20 |

The strength of the green briquets was good enough to be subjected to further treatment. However, in general the binding effect decreased with increasing particle size, accompanied by a decreased strength. No connection with the sample composition was found. However, if the green strength is insufficient it can be improved by adding binders such as coal tar pitch or bitumen.

Sintering

The object of the sintering experiments was to find if the briquets should be provided pre-sintered to the furnace, thus decreasing the gas volume to be cleaned from the furnace gas outlet, and to examine whether coal can be used as binder. Sintering of the briquets was performed in an alsint crucible with a lid in air atmosphere. The lid did however allow for degassing from the material. Experimental values are listed below. The sintering was performed in 30 minutes at sintering temperature. Experiment no. 1a means a heat treated briquet from experiment no. 1.

TABLE 5

| Strength and weight loss in briquets after sintering | | | |
|---|---|---|---|
| Experiment no. | Sintering temperature (°C.) | Weight loss after sintering (%) | Strength after treatment |
| 1a | 400 | 6.2 | Good |
| 2 | 470 | 12.3 | Good |
| 3a | 470 | 10.0 | No |
| 4a | 500 | 13.3 | No |
| 5a | 485 | 8.9 | Good |
| 6a | 485 | 13.4 | Good |
| 7a | 490 | 12.7 | Good |
| 8 | 1200 | 22.5 | Good |

In experiment no. 3a and 4a it was impossible to cause the material to establish a sufficiently strong bond during sintering to maintain its shape after the treatment. A practical upper limit for coal particles seems in this case to be in the range from 2 to 2.5 mm. The upper particle size limit will however vary with the particle size distribution and the coal plasticity/viscosity at heating through the plastic temperature range. A large portion of fines can however allow for a coarse portion of relatively large maximum size. The weight loss after sintering is due to water and volatile matter in the coal, and shows a connection between weight loss and sintering temperature including coal content of the sample. Beyond the above mentioned, no connection between the briquet composition and strength of sintered samples was found.

Shock heating/quick calcining

The object of these experiments was to find how the sintered briquets reacts when suddenly heated, corresponding to the conditions occuring at the furnace top. If the material lacks sufficient gas permeability, the briquets can burst due to internal gas pressure, which in case is an undesirable effect.

The heating rates which are present at the top of a charge in melting furnaces corresponds to a heating to 1200° C. during 2–12 minutes, depending on the location of the briquets on the furnace surface and the operating conditions of the furnace. In this example, a graphite crucible with a lid was preheated to 1200°–1230° C. in an induction furnace charged with about 150 grams of briquets. The heating of the briquets occured within a few minutes and the degassing which produced flames stopped after 6–8 minutes. After a total of 17.5 minutes the briquets were quenched, and strength and weight loss was evaluated. For sample no. 6a and 7a the time was 15 minutes. Table 6 below shows the weight loss of each sample.

TABLE 6

| Weight loss after shock heating | |
|---|---|
| Tested material | Total weight loss: sintering and shick heating (%) |
| 1a | 39.2 |
| 2 | 41.0 |
| 5a | 38.8 |
| 6a | 40.3 |
| 7a | 40.1 |
| 8 | 22.5 |

The designation 1a refers to tesing of a sample material sintered in experiment no. 1a. The material strength after the treatment was weakened but was still sufficiently good. Table 7 shows how the sample composition is changed. This material balance is based upon the same assumptions as set forth above. It is however difficult to draw any conclusion about the effect of the coal particle size with support in this relatively spare data basis. The effect of the briquet composition do not seem to have any importance to the degree of conversion of oxygen in magnetite. It shows a scattering which is independent on both composition and time, but except from test no. 8, most of the iron oxide seems to be reduced to iron.

TABLE 7

Element/component analysis prior to and after shock heating

| Tested material | Prior to heat treatment | | | | | After heat treatment | | | |
|---|---|---|---|---|---|---|---|---|---|
| | vt % ash/inert | vt % vol. matter | vt % C | vt % Fe | vt % O | vt % ash/inert | vt % C | vt % Fe | vt % O |
| 1a | 5.9 | 18.5 | 24.8 | 36.8 | 14.0 | 9.7 | 26.1 | 60.6 | 3.6 |
| 2 | 5.9 | 18.5 | 24.8 | 36.8 | 14.0 | 10.0 | 25.6 | 62.4 | 2.0 |
| 5a | 6.1 | 16.4 | 22.0 | 40.2 | 15.3 | 10.0 | 20.3 | 65.6 | 4.1 |
| 6a | 5.4 | 24.6 | 33.0 | 26.8 | 10.2 | 9.0 | 44.0 | 44.9 | 2.1 |
| 7a | 5.3 | 26.2 | 35.2 | 24.1 | 9.2 | 8.8 | 48.9 | 40.2 | 2.1 |
| 8 | 1.8 | 18.0 | 40.2 | 29.0 | 11.0 | 2.5 | 49.8 | 39.8 | 8.0 |

SiO reactivity and formation of ferrosilicon

The material from the shock heating had now been subjected to the heat treatment expected to occur in a furnace, and the material was therefore used in further experimenting to test the SiO reactivity. SiO reactivity is a test method for reduction materials used by professionals to evaluate their suitability for production of Si metal, ferrosilicon or silicone carbide, and is described in the literature. See for example "J Kr. Tuset and O. Raaness "Reactivity of Reduction Materials in the Production of Silicon, Silicon-Rich Perro Alloys and Silicon Carbide", AIME El.Furnace Conf., St. Louis, Mo. 7–10 Dec. 1976. The reactivity test was performed in a gas mixture in which the ratio SiO/CO gas was three, i.e. 13.5 vol % SiO, 4.5 vol % CO and the balance argon carrier gas; a condition which represents a typical ratio between SiO and CO which can be found in zones of a melting furnace. Pure carbon at 1650° C. can then form silicone carbide, but no molten metal phase. However, whereas an iron component is present, a molten ferrosilicon phase is formed, in addition to SiC. From chemical equlibrium considerations, a Si content of 20% should be expected.

A total of 5 experiments were performed on calcined material. The samples tested and the results are listed below. The designation "1a-cal" refers to testing of calcined material no. 1a. The SiO reactivity reflects a material's effectivity to absorb SiO from a gas flow. The reactivity number is the quantity of SiO that passes unreacted through a througly defined bed. A low number represents low losses and accordingly higly reactive material. Transferred to commercial furnaces this will represent high yields of energi and raw materials.

TABLE 8

SiO reactivity

| Tested material | SiO reactivity number (ml $SiO_{(g)}$) | Weight gain (%) |
|---|---|---|
| 1a-cal | 432 | 22 |
| 2c-cal | 522 | 19 |
| 5a-cal | 381 | 17 |
| 6a-cal | 588 | 38 |
| 7a-cal | 853 | 47 |
| 8 | 712 | — |

These SiO reactivity values correspond to the values found with char coal, in other words, this is a higly reactive material. The samples had a rather equal composition, but Table 8 shows that sample no. 8 is more reactive than sample no. 7a.

Table 9 below shows a material balance for the experiments. Initial analysis descends from Table 7 above, which are calculated analyses. These calculations with regard to coked material is for one experiment controlled according to the values obtained from chemical analysis, which exhibited quite good conformity. In the outgoing analysis the material was analyzed with regard to silicon, carbon and iron.

TABLE 9

Material analysis of briquets prior to and after test of reactivity

| Tested material | Initial analysis (vekt %) | | | | Outgoing analysis (wt %) | | | | Calc. composition on basis of analysis | | |
|---|---|---|---|---|---|---|---|---|---|---|---|
| | ash/inert | C | Fe | O | ash/inert | C | Fe | Si | SiC | Fe—Si | Silicone in ferrosilicone |
| 1a-cal | 9.7 | 26.1 | 60.6 | 3.6 | 6.5 | 2.7 | 46.1 | 44.7 | 9.0 | 84.5 | 45.4 |
| 3c-cal | 10.0 | 25.6 | 62.4 | 2.0 | 2.0 | 1.4 | 54.3 | 42.3 | 4.7 | 93.3 | 41.8 |
| 5a-cal | 10.0 | 20.3 | 65.6 | 4.1 | 6.9 | 1.4 | 55.3 | 36.4 | 4.7 | 88.4 | 37.5 |
| 6a-cal | 9.0 | 44.0 | 44.9 | 2.1 | 2.1 | 8.1 | 33.1 | 56.7 | 27.1 | 70.8 | 53.3 |
| 7a-cal | 8.8 | 48.9 | 40.2 | 2.1 | 3.4 | 10.7 | 28.4 | 57.5 | 35.8 | 60.8 | 53.3 |
| 8 | 2.5 | 49.8 | 39.8 | 8.0 | 4.6 | 7.7 | 25.0 | 62.7 | 26.0 | 70.0 | 64.0 |

The material balance shows that the metal phase formed in these tests contains far more silicone than expected in the beginning. As mentioned above, a preferred carbon to iron ratio in a briquet is about 1.2:1 with respect to both FeSi yield and Si content in FeSi produced.

EXAMPLE 2

This example illustrates the SiO reactivity for coal/slig briquets produced by a briquet-forming method in a pilot plant.

Briqueting

The briqueting was performed in a continous roller press. Several test batches were produced from Sydvaranger pellet slig, Longyear coal and pitch as binder. A mixture comprising 64 wt % coal (<2 mm) and 36 wt % slig was supplied with 6, 7 or 8 wt % pitch. Moreover, some briquets from each mixture were sintered in an air atmosphere at 400° C. for 10 minutes to find any eventual effect on properties as quick calcining and SiO reactivity. The major part of the production was to be used for pilot plant melting experiments, which was performed with 7 wt % pitch. The chemical composition of these green briquets are stated in Table 10 below.

TABLE 10

Briquet composition

| Component | Wt % |
|---|---|
| Ash/inert | 4.9 |
| $SiO_2$ from ash/inert | 2.0 |
| V.M.* | 28.8 |
| C | 35.2 |
| $Fe_3O_4$ | 31.1 |

*V.M.-volatile matter

The respective briquets had a pillow like shape with a dimension of 35×35 mm and a maximum thickness of 20 mm.

Shock heating/quick calcining

The pressed briquets were subjected to shock heating corresponding to Example 1 above, but where time to temperature was 15 minutes. Briquets added 6 and 7% pitch were tested, and Table 11 shows the results. During the first 30 seconds there was a lot of black smoke due to the removal of pitch, whereas the strong degassing of the remaining volatile components lasted for 4–5 minutes. The strength of the briquets was still good enough after this treatment, and shows that the briquets, if desired, can be charged directly to a ferrosilicon furnace without pretreatment.

TABLE 11

Weight loss in briquets after heating

| Tested material | Weight loss after shock heating (%) |
|---|---|
| 7%-unsintered | 45.0 |
| 7%-sintered | 37.2 |
| 6%-unsintered | 44.3 |
| 6%-sintered | 36.3 |

Sintered material provided the lowest weight loss since some volatile matter was removed during the first heating, and the fact that the samples having the highest content of pitch resulted in most weight loss is apparently also correct, since pitch contains more volatile material than coal. This material balance is based upon the same assumptions as before. The term "green briquet" is in this context referred to the composition of a pressed briquet ready for use.

TABLE 12

Elemental analysis of briquet prior to and after shock heating

| | "Green briquet" (wt %) | | | | | After heat treatment (wt %) | | | |
|---|---|---|---|---|---|---|---|---|---|
| Tested mat. | ash/ inert | vol. mat. | C | Fe | O | ash/ inert | C | Fe | O |
| 7%-i.s. | 4.9 | 28.8 | 35.2 | 22.5 | 8.6 | 8.9 | 50.2 | 40.9 | 0 |
| 6%-i.s. | 4.9 | 28.4 | 35.2 | 22.8 | 8.70 | 8.9 | 50.2 | 40.9 | 0 |

i.s. = not sintered

According to the results above, the iron oxide was reduced completly during the experiment.

SiO reactivity and formation of ferrosilicon

The calcined material had now obtained the thermal treatment which is expected in a furnace, and the material was therefore used to test the SiO reactivity. Table 14 shows the material tested and the results.

TABLE 13

SiO reactivity

| Tested material | SiO reactivity number (ml $SiO_{(g)}$) | Weight gain (%) |
|---|---|---|
| 7% unsintered | 1094 | 37 |
| 7%-sintered | 1002 | 49 |

A professional would with these reactivity numbers have classified the material as highly reactive material. Table 14 which shows a chemical analysis of completely reacted material reveals that the pre-sintered material provided the best results, both with respect to reactivity and silicon absorption. The metal produced is still richer in silicone than expected.

TABLE 14

Analysis of briquets after reaction

| | Outgoing analysis | | | | | | |
|---|---|---|---|---|---|---|---|
| Tested material | wt % ash/ inert | wt % C | wt % Fe | wt % Si | wt % SiC | wt % Fe—Si | wt % Si in Fe—Si |
| 7% n.s. | 3.5 | 10.5 | 31.7 | 54.3 | 35.1 | 61.4 | 48.4 |
| 7% s. | 2.5 | 10.3 | 27.5 | 59.7 | 34.4 | 63.1 | 56.4 |

i.s. = not sintered
s. = sintered

The briquets produced with a briquetting machine and a laboratory press behave in a similar manner when quickly heated and exposed to SiO/CO gas, temperature course and chemical reactions like the conditions present in a ferrosilicon furnace. Coked material comprising reduced iron reacts as a highly reactive material by contact with gaseous SiO, and ferrosilicon is formed with a silicon content of about 50%. The maximum Si content in the FeSi produced was 64% Si. Transferred to furnaces of commercial scale such reaction cheme can provide a faster metal formation than obtainable with known raw materials. Thus, the coal/slig briquets appear to enable production with better utilization of the SiO gas and then a decreased power consumption.

EXAMPLE 3

This example illustrates the energy savings obtained according to the present method. Experiments were performed in a pilot plant with a furnace having an effect of 150 kW.

Initially, trials were run with a normal charge consisting of iron ore pellets from AS Sydvaranger, spanish quartz crushed and screened to a screen size of 15–5 mm. As carbon cource a higly reactive char from Australia was used, which was screened to a particle size of 5–15 mm. During a start up period of 15 hours the furnace charge was built up, and the carbon load was increased progressively from 80% to 95% load of required, i.e. the carbon was present in 20–5% stochiometric deficiency to effect complete removal of oxygen bound to silicon (to avoid accumulation of carbide in the furnace). Then, a stable test period was run with the coke load as described above, from which the test production results were evaluated.

In a comparative test the iron portion was charged in the form of briquets corresponding to Table 12 with 6% pitch (not sintered). In order to maintain as identical conditions as possible the briquets were crushed to a size of 5–15 mm. The char was supplied in a quantity that resulted in the same carbon load as with the normal charge. The remaining operating conditions were kept identical with regard to electrical parameters and operating mode.

The test results with briquets performed according to the invention provided a Si yield of 71.7 wt % (on the basis of total quantity of Si charged to the furnace) as compared with the ordinary charge (char and ore separately) which resulted in a yield of 60.9%, i.e. an improvement of 10%. The energy consumption for the experiment with briquets performed according to the invention was 16% lower pr kg 75% FeSi produced than obtained through an ordinary charge.

Moreover, one of the most important operating parameters which was discovered with these experiments is that the need for poling the furnace between each charge added vanished with the use of briquets. By using a normal charge the furnace top was hot and sticky, and the operators had to pole the furnace frequently to avoid blow-outs, i.e. unchecked release of SiO/Si/CO gas from the furnace crater.

The increase in Si yield and reduction of energy consumption stated above can however not be implemented directly in a furnace of commercial scale.

I claim:

1. In a method for production of ferrosilicon in an electric reduction furnace by the reaction of iron-containing, silica-containing and carbonaceous materials, the improvement comprising supplying the furnace, with iron-containing and carbonaceous materials in the form of agglomerates consisting essentially of a substantially homogeneous mixture of iron or a reducible iron compound and the carbonaceous material, having a weight ratio of carbon to iron of 0.2:1 to 1.5:1 after reaction in the furnace.

2. A method according to claim 1, wherein the agglomerates have a pore content of 30 to 80% after reaction in the furnace at a temperature of at least 1200° C.

3. A method according to claim 1, wherein the carbonaceous material comprises swelling coal with a free swelling index of at least 1.

4. A method according to claim 1, wherein the reducible iron compound is iron oxide.

5. A method according to claim 4, wherein the iron oxide is hematite.

6. A method according to claim 1, wherein the carbonaceous material is coal crushed to a particle size no greater than 5 mm.

7. Agglomerates for the production of ferrosilicon in an electric reduction furnace consisting essentially of a substantially homogeneous mixture of iron or a reducible iron compound and a carbonaceous material having a weight ratio between carbon and iron in reduced form of 0.2:1 to 1.5:1, said agglomerates being adapted for reaction with silica in an electric reduction furnace for production of ferrosilicon.

8. Agglomerates according to claim 7, having a pore content of 30 to 80% in reduced form after heating to at least 1200° C.

9. Agglomerates according to claim 7, wherein the carbonaceous material comprises swelling coal having a free swelling index of at least 1.

10. Agglomerates according to claim 7, wherein the reducible iron compound comprises iron oxide.

11. Agglomerates according to claim 10, wherein the iron oxide comprises hematite.

12. Agglomerates according to claim 7, wherein the carbonaceous material comprises crushed coal of particle size no greater than 5 mm.

* * * * *